United States Patent [19]

Stumpp

[11] 3,930,479

[45] Jan. 6, 1976

[54] FUEL METERING DEVICE FOR EXTERNALLY IGNITED INTERNAL COMBUSTION ENGINES WITH COMPRESSION OF THE AIR-FUEL MIXTURE

[75] Inventor: Gerhard Stumpp, Stuttgart, Germany

[73] Assignee: Robert Bosch G.m.b.H., Stuttgart, Germany

[22] Filed: Aug. 31, 1973

[21] Appl. No.: 393,508

[30] Foreign Application Priority Data

Sept. 7, 1972 Germany ..... 2243925

[52] U.S. Cl. .... 123/139 AW; 123/119 D; 123/97 B

[51] Int. Cl.[2] ..... F02M 39/00

[58] Field of Search.. 123/119 D, 119 DB, 139 AW, 123/97 B

[56] References Cited

UNITED STATES PATENTS

| | | | |
|---|---|---|---|
| 3,561,412 | 2/1971 | Yazi | 123/119 DB |
| 3,601,106 | 8/1971 | Nakajima | 123/119 D |
| 3,628,515 | 12/1971 | Knapp | 123/139 AW |
| 3,698,371 | 10/1972 | Mitsuyama | 123/119 DB |
| 3,703,888 | 11/1972 | Echert et al. | 123/139 AW |
| 3,710,769 | 1/1973 | Knapp | 123/139 AW |
| 3,738,109 | 6/1973 | Tatsutome | 123/119 D |
| 3,795,230 | 3/1974 | Voshimiera | 123/119 D |

*Primary Examiner*—Charles J. Myhre
*Assistant Examiner*—R. H. Lazarus
*Attorney, Agent, or Firm*—Edwin E. Greigg

[57] ABSTRACT

In a fuel metering device for an externally ignited internal combustion engine with compression of the air-fuel mixture, which system comprises a suction tube for the intake of air in which an air-measuring device and a randomly adjustable throttle valve having a flap are arranged in sequence, and in which an essentially proportionate amount of fuel is metered into the amount of air flowing therethrough, and wherein the proportionality of the fuel amount is adjustable by means of controlling a bypass circumventing the air-measuring device in dependence on engine data, there is described an improvement which comprises a valve arranged in the bypass, the said valve being controllable by the pressure prevailing in the suction tube in the vicinity of the throttle valve, a pneumatically actuated valve means adapted for controlling the valve in the bypass, and conduit means connecting the pneumatically actuated valve means with the suction tube and having an orifice in the latter which orifice is located upstream of the throttle valve, taken in the direction of air flow through the suction tube, and also upstream of the part of the flap of the throttle valve moving against the flow of air during the release of the air supply, yet still in the immediate vicinity of the said flap part.

10 Claims, 4 Drawing Figures

FUEL METERING DEVICE FOR EXTERNALLY IGNITED INTERNAL COMBUSTION ENGINES WITH COMPRESSION OF THE AIR-FUEL MIXTURE

BACKGROUND OF THE INVENTION

This invention relates to a fuel-metering system for externally ignited internal combustion engines with compression of the air-fuel mixture, which system comprises a suction tube for the intake of air in which an air-measuring device and a randomly adjustable throttle valve are arranged in sequence, and in which an essentially proportionate amount of fuel is metered into the amount of air flowing therethrough, the proportionality of the fuel amount being adjustable by means of controlling a bypass circumventing the air-measuring device in dependence on engine data.

Fuel-metering systems are already known in which this proportionality between fuel amount and air amount is adjustable in dependence on engine data, in which however, an optimal ratio in the mixture cannot be attained, even though the same rate of air flow prevails at several operating levels in the engine performance graph, as the requirements with regard to the air-fuel mixture are different ones for these levels.

OBJECTS AND SUMMARY OF THE INVENTION

It is an object of the invention to improve the aforesaid fuel-metering system so as to achieve an improved adaptation of the air-fuel mixture to these differing requirements by means of a simple device.

This object is attained according to the invention by providing in the initially described fuel-metering system a valve which is arranged in the aforesaid bypass, being controllable by the pressure prevailing in the suction tube in the vicinity of the throttle valve and by providing the orifice of the control conduit of a pneumatically actuated valve means which controls the aforesaid valve in the bypass, in the suction tube upstream of the throttle valve, in the direction of air flow, so as to monitor the pressure during a position of the throttle valve corresponding to idling and also upstream of the part of the throttle valve flap when the latter is moved against the flow of air during the release of the air supply, yet still in the immediate vicinity of the said flap part of the throttle valve, so that the pressure prevailing downstream of the throttle valve also prevails at the orifice when the throttle is opened more widely.

Thereby the bypass is closed during full load, i.e., at high air pressure in the suction tube, and an enriched mixture as desired for highest performance is obtained. During partial load, however, when there is a low air pressure in the suction tube, the bypass is open, whereby a desired mixture of lower fuel content is obtained. In the position of the throttle valve at idling, the orifice is located upstream of the throttle valve; the bypass is therefore closed, and the enriched mixture necessary for a smooth running of the engine is obtained.

When starting the engine, a high suction tube air pressure again prevails regardless of the position of the throttle valve. The bypass is therefore closed and the mixture is enriched as required.

In an advantageous embodiment of the invention there is disposed in the bypass a control element which can be adjusted arbitrarily, independently of engine data, to control the cross-sectional area of the bypass; this control member can be devised as a throttle member, and may be arranged at the opening of the bypass in the suction tube. In the latter arrangement, the throttle member acts in the same manner as the throttle valve of the engine, and causes with increasing rpm a multiplicative decrease of the fuel content in the air-fuel mixture.

In an advantageous embodiment of the invention, the one opening of the bypass is also arranged upstream of the closed throttle valve and upstream of the part of the flap of the throttle valve member moving against the flow of air during the release of the air supply, but still in the immediate range of the said part of the throttle valve flap. Thereby, an excessive decrease of fuel in the mixture in the case of a small throttle valve opening is avoided; moreover, the sealing problems are avoided which would otherwise arise in the valve when in the idling position. Also, when the position of the throttle valve flap is constant, a greater dilution of the mixture is attained with rising rpm.

In a corresponding embodiment, the orifice of the control conduit and/or of the bypass, which orifice is exposed to the pressure prevailing upstream of the throttle valve when the latter is closed, is influenced, in continuously increasing degree, by the pressure drop produced in the internal combustion engine during the course of the opening movement of the throttle valve. Thereby, an advantageous refinement in the adaptation of the air-fuel mixture to operating conditions is achieved.

This adaptation of the air-fuel mixture can be further refined by having the valve in the bypass control two independent air flowpaths, and the pneumatically actuated valve means is provided with two control lines for controlling these two air flowpaths, which lines open into the suction tube, one downstream of the other in the flow direction.

According to yet another embodiment of the invention, a variable throttle means is arranged in at least one of these control lines. Thereby, it is possible for the valve in the bypass to open slowly during sudden acceleration, so that the air-fuel mixture is enriched during the transitional phase from lower to higher engine speed. However, if the throttle valve is closed at high rpm, then the valve will close the bypass slowly, thus effecting, for a short time, an impoverishment of the mixture which is otherwise too enriched due to the sudden closing of the throttle valve. The rpm is thus adjusted more safely to the idling of the engine.

In order to give more weight to the load on the engine data, a cross-section-controlling device is arranged in the bypass, in addition to the valve, which device can be actuated regardless of the position of the throttle valve flap in the suction tube.

The invention will be better understood and further objects and advantages will become apparent from the following detailed specification of preferred but merely exemplary embodiments taken in conjunction with the drawings.

DESCRIPTION AND OPERATION OF THE EMBODIMENTS

Figure 1:
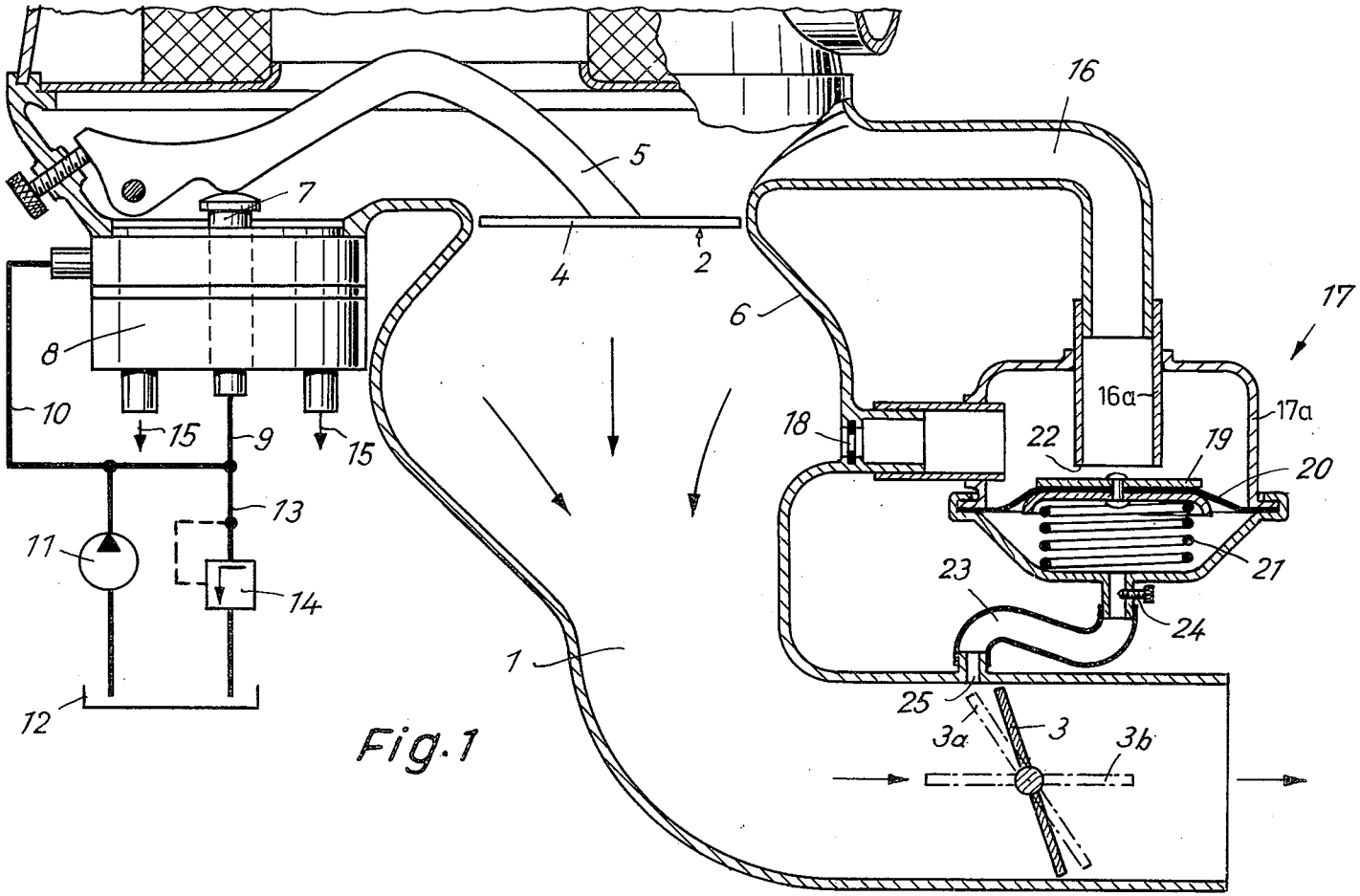
FIG. 1 shows in a schematical view a first embodiment of the fuel metering device according to the invention.

As shown in FIG. 1, an air-measuring device 2 and a throttle valve 3 are arranged in a suction tube 1 successively in the direction of air flow therethrough (as indicated by arrows). The air-measuring device 2 is, for example, designed as a plate 4 which is disposed to extend transversely to the direction of air flow, and which is attached to a lever 5 in such a manner as to penetrate during its measuring motion into a frustoconical zone 6 of the suction tube, in accordance with an approximately linear function of the amount of air flowing through the suction tube 1. Lever 5, being supported in a bearing with the least possible friction, actuates during its swivelling motion the movable valve member 7 of a fuel-metering valve. The fuel which is supplied under constant pressure through a fuel line 9 and which is fed into the metering valve 8 via a branch-line 10, acts upon the frontal face (not shown) of the movable valve member 7, at the end thereof opposite the contact end with lever 5, and thus serves to reset the plate 4 always with a constant resetting force.

The supply of fuel takes place via an electrically operated fuel pump 11 which aspirates the fuel from a reservoir 12 and conveys it via line 9 to the metering valve 8. A line 13 having a pressure-regulating valve 14 interposed therein branches off from line 9. The quantitatively metered fuel is distributed by metering valve 8 to individual lines 15 which lead each to an injection valve (not shown). A carburetor of a hot-wire measuring device may also serve as the air-measuring device 2.

The zones of the suction tube upstream and downstream of the air-measuring device 2 are connected with one another by means of a bypass 16 which is controlled by means of a pneumatically actuated control valve 17. The cross-sectional area of bypass 16 may moreover be randomly changed and may be preset by means of a throttle passage 18 which is preferably provided in an exchangeable throttle member, which may be replaced by others having passages of various widths. The pneumatically actuated valve 17 is actuated by displacing a valve plate 19 which is suspended from a membrane 20 and is urged onto a valve seat 22 by means of a valve closing spring 21. Valve seat 22 is constituted by the rim of a tube extension 16*a* which opens into the interior of valve housing 17*a*. The chamber of valve 17 which houses spring 21 communicates with suction tube 1 by way of control conduit 23. An obstruction in the form of screw 24 causing a throttling effect is disposed in control conduit 23 whose cross-section is thereby randomly adjustable, and which attenuates the movements of valve plate 19. Control conduit 23 opens into the suction tube 1 through an orifice 25 just upstream of throttle valve 3 when the flap of the latter is in a closed position. The wider throttle valve 3 is opened, the more the air pressure prevailing downstream of throttle valve 3 also influences the air pressure in orifice 25. However, it must be taken into account that the said influence is so small as to be neglected when the flap of throttle valve 3 is in the idling position indicated at 3*a*, while, when the flap of throttle valve 3 is in the full load position indicated at 3*b*, the pressure prevailing downstream of the throttle valve 3 will fully influence the pressure in orifice 25. Correspondingly, the influence of the pressure prevailing downstream of the throttle valve 3 varies during the different positions of the flap of the latter.

Figure 2:
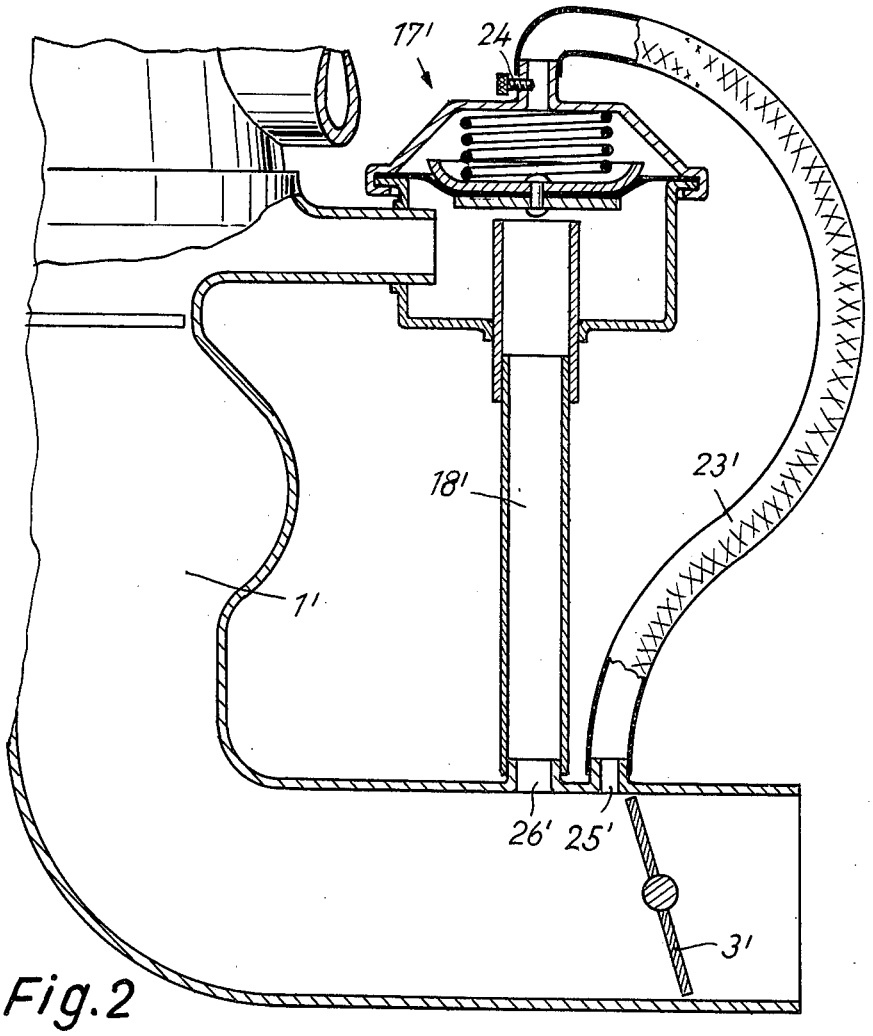
FIG. 2 is a partial view of a similar embodiment as shown in FIG. 1 but having a somewhat different arrangement of the pneumatically actuated valve means therein.
Figure 3:
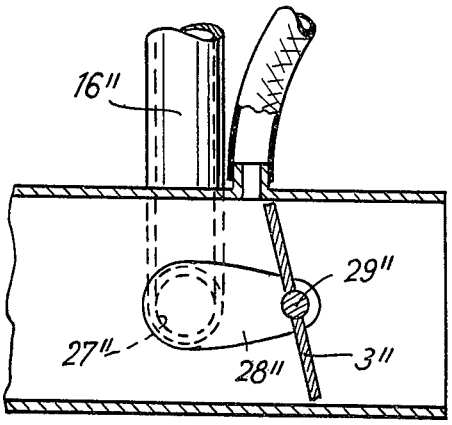
FIG. 3 shows in a partial view a somewhat different connection of the last-mentioned valve to the suction tube in an arrangement as shown in FIG. 2.

In the embodiment shown in FIG. 2, bypass 23′ opens through orifice 25′ into suction tube 1′ at a point which is still within the pressure-influencing reach of the flap of throttle valve 3′. Thereby, pressure in orifice 26′ is influenced by the position of the flap of throttle valve 3′ in a manner similar to that described above for orifice 25 of control conduit 23. On the other hand, conduit 18′ opens through orifice 26′ much closer to orifice 25′, upstream of the latter, than in the embodiment of FIG. 1. Control of valve 17′ occurs in the same manner as in the case of the embodiment shown in FIG. 1. FIG. 3 shows a variation of the embodiment shown in FIG. 2, wherein the free cross-sectional area of the aperture 27″ of bypass 16″ is controlled by means of a cam disc 28″ whose rim is profiled and which is mounted on the shaft 29″ of throttle valve 3″ in a plane at a right angle to the flap thereof so that the disc 28″ can be turned together with the flap of throttle valve 3″.

Figure 4:
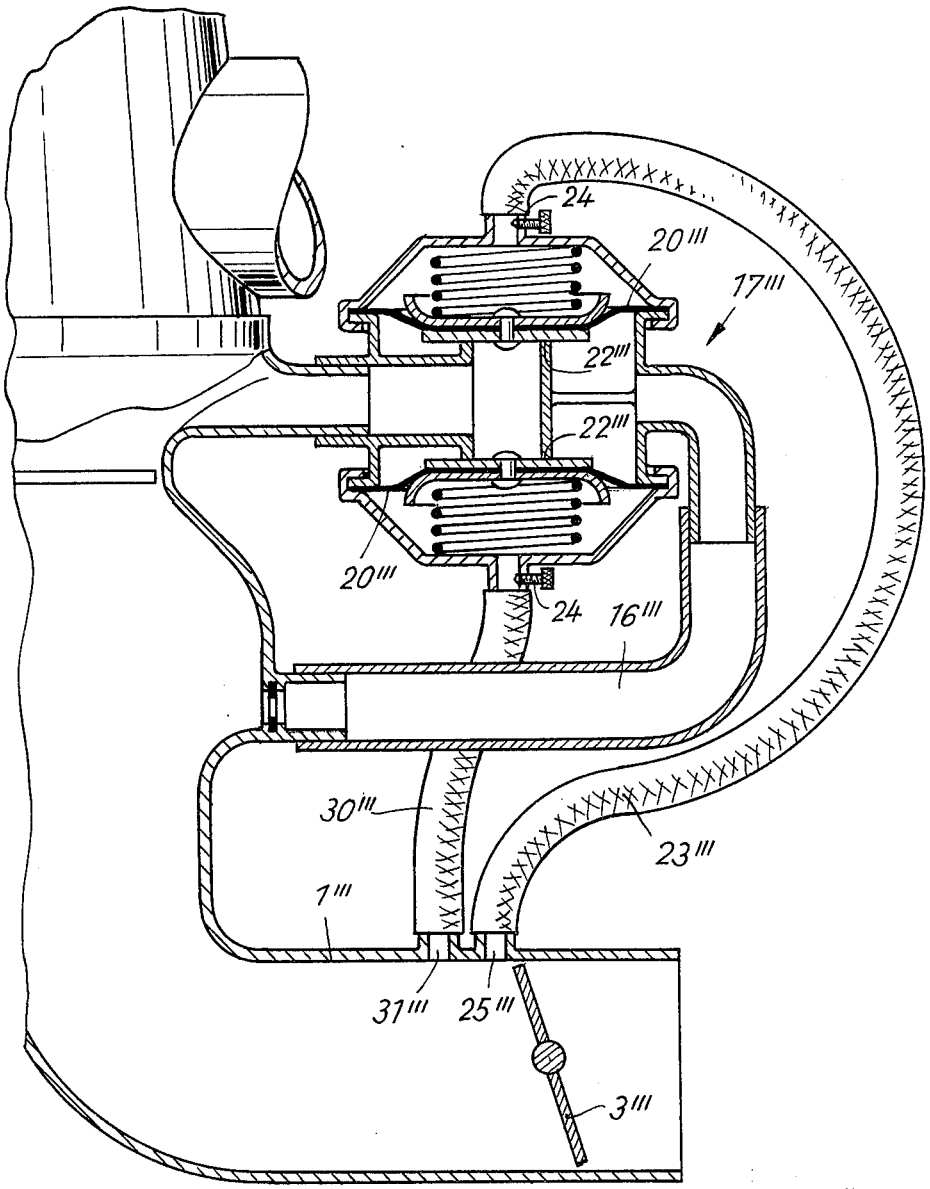
FIG. 4 shows in partial view yet another arrangement of the pneumatically actuated valve means in the fuel metering device according to the invention.

A control valve 17‴ is shown in FIG. 4, which operates by means of two membranes 20‴, each controlling a valve seat 22‴. The chambers upstream and downstream of these seats 22‴ communicate with the suction tube by way of bypass 16‴. Control conduits 23‴ and 30‴ open in sequence into suction tube 1‴, orifice 31‴ being upstream in flow direction relative to orifice 25‴, and thereby being only exposed to the pressure changes caused by throttle valve 3‴ when the flap of the latter is opened more widely. Thereby, a further refinement in the adjustment of the air-fuel mixture is possible.

What is claimed is:

1. In a fuel metering device for an externally ignited internal combustion engine with compression of the air-fuel mixture, which system comprises a suction tube for the intake of air in which an air-measuring device and a randomly adjustable throttle valve having a flap are arranged in sequence, and in which an essentially proportionate amount of fuel is metered into the amount of air flowing therethrough and wherein the proportionality of the fuel amount is adjustable by means of controlling a bypass circumventing the air-measuring device in dependence on engine data, the improvement conprising:

a. a valve arranged in said bypass, and controllable by the pressure prevailing in said suction tube in the vicinity of said throttle valve, said valve including a pneumatically actuated valve means mounted for controlling said valve in said bypass; and b. conduit means connecting said pneumatically actuated valve means with said suction tube, said conduit means having an orifice located upstream of said throttle valve, taken in the direction of air flow through said suction tube, and also upstream of the part of the flap of said throttle valve moving against the flow of air during the release of the air supply, yet still in the immediate vicinity of said flap part.

2. The improvement as described in claim 1, further comprising means having a passage therethrough and being adapted for having the cross-sectional area of said passage randomly varied independently of engine data.

3. The improvement as described in claim 2, wherein said means having a passage therethrough are throttle means disposed at the mouth of said bypass in said suction tube.

4. The improvement as described in claim 3, wherein said mouth of said bypass is located upstream of said throttle valve flap when the latter is closed, and also upstream of the part of said throttle valve flap which moves against the air flow through said suction tube when the air supply is released, but still within the immediate reach of said part of said flap.

5. The improvement as described in claim 4, wherein said mouth of said bypass or said orifice of said control conduit or both said mouth and said conduit are so located in said suction tube relative to said throttle valve flap that the pressure drop produced in the engine will prevail therein in continuously increasing degree during an opening movement of said flap of said throttle valve.

6. The improvement as described in claim 1, wherein said valve in said bypass comprises two flow paths being independent of one another, and wherein said pneumatically actuated valve means comprise two control conduits opening into said suction tube through orifices disposed in said suction tube in series, said control conduits being associated with said flowpaths for controlling the flow of air therethrough.

7. The improvement as described in claim 6, wherein at least one of said control conduits comprises throttle means therein, which throttle means comprise means for varying the cross-sectional throttling passage therethrough.

8. The improvement as described in claim 1, wherein said pneumatically actuated valve means comprise a membrane, a chamber housing said membrane, and spring means for urging said membrane into closed position, said chamber being in communication with said suction tube by way of said control conduit.

9. The improvement as described in claim 1, wherein said throttle valve comprises means for controlling the cross-sectional area of said mouth of said bypass in said suction tube, in dependence on the position of said flap of said throttle valve in said suction tube.

10. The improvement as defined in claim 1, wherein the conduit means comprises throttle means therein which serve for varying the cross-sectional throttling passage therethrough.

* * * * *